United States Patent [19]

Wieman

[11] 4,051,995

[45] Oct. 4, 1977

[54] STUFFED ENVELOPE ASSEMBLY

[75] Inventor: Robert L. Wieman, Sycamore, Ill.

[73] Assignee: Duplex Products, Inc., Sycamore, Ill.

[21] Appl. No.: 636,809

[22] Filed: Dec. 1, 1975

[51] Int. Cl.[2] ..... B65D 27/10

[52] U.S. Cl. ..... 229/69; 206/627; 206/629; 282/11.5 A

[58] Field of Search ..... 229/69, 85; 282/11.5 A, 282/25

[56] References Cited

U.S. PATENT DOCUMENTS

| | | | |
|---|---|---|---|
| 3,554,438 | 1/1971 | Van Malderghem | 229/85 X |
| 3,902,655 | 9/1975 | Huffman | 229/85 X |
| 3,905,545 | 9/1975 | Juszak | 229/85 X |
| 3,941,307 | 3/1976 | Van Malderghem | 229/85 |

FOREIGN PATENT DOCUMENTS

| | | | |
|---|---|---|---|
| 790,434 | 7/1968 | Canada | 229/69 |
| 1,058,635 | 2/1967 | United Kingdom | 282/11.5 A |

*Primary Examiner*—Stephen P. Garbe
*Attorney, Agent, or Firm*—J. Warren Kinney, Jr.

[57] ABSTRACT

A plurality of continuous plys are superposed to comprise the top and bottom panels of a mailing envelope having insert panels therebetween, and, in one modification, having a record panel overlying the top envelope panel. Each of the panels which collectively comprise the stuffed envelope assembly are of the same size, and means are provided for enabling the envelope to be opened concurrently with the removal of an upper edge of each of the insert panels thereby providing an access to the central, removable portion of the insert panels which portions are secured along their respective side and bottom edges to marginal portions of the insert panels, said marginal portions being fixedly secured to corresponding marginal portions of the envelope-defining panels.

10 Claims, 9 Drawing Figures

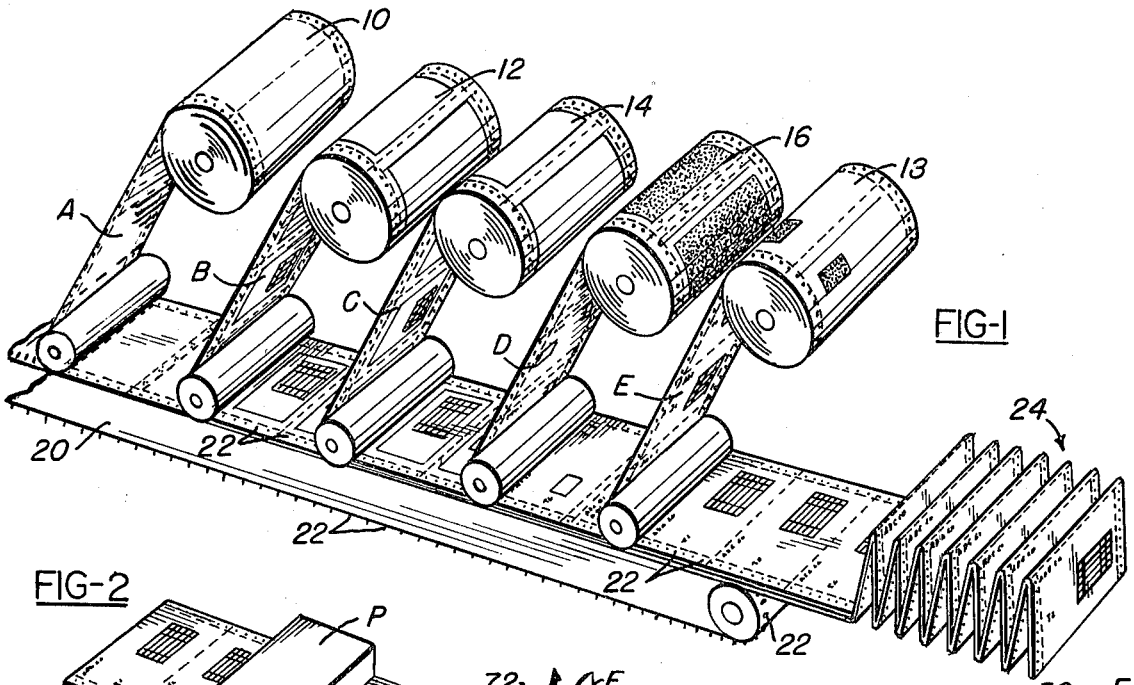
FIG-1
FIG-2
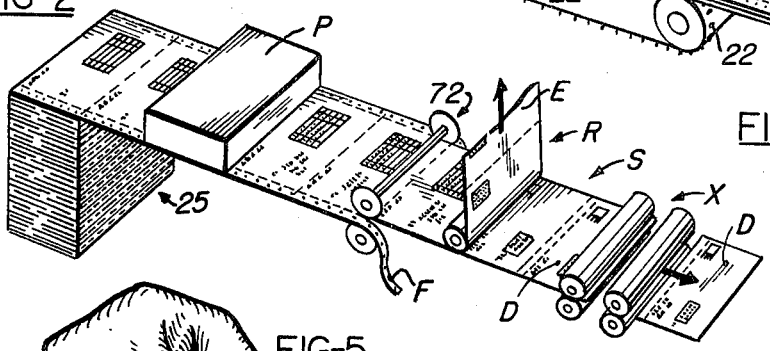
FIG-8
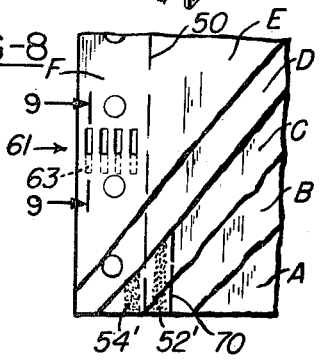
FIG-5
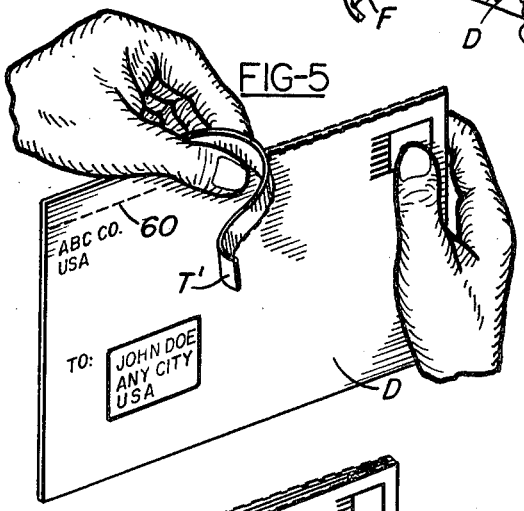
FIG-7
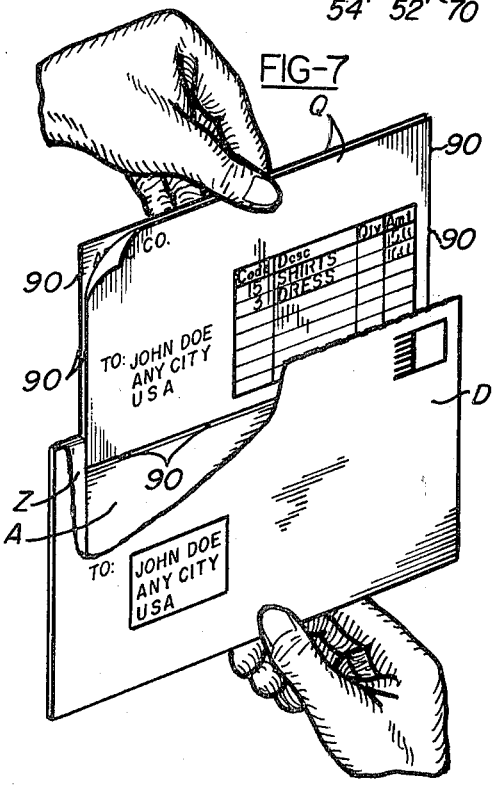
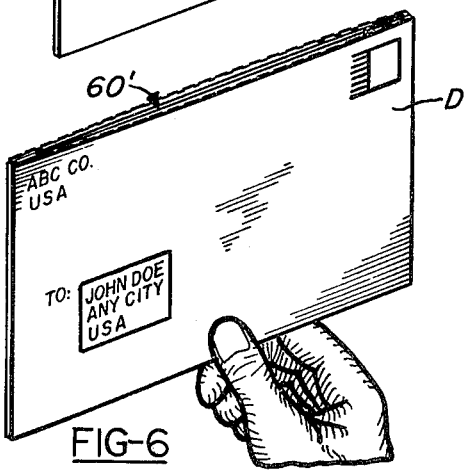
FIG-6

FIG-3
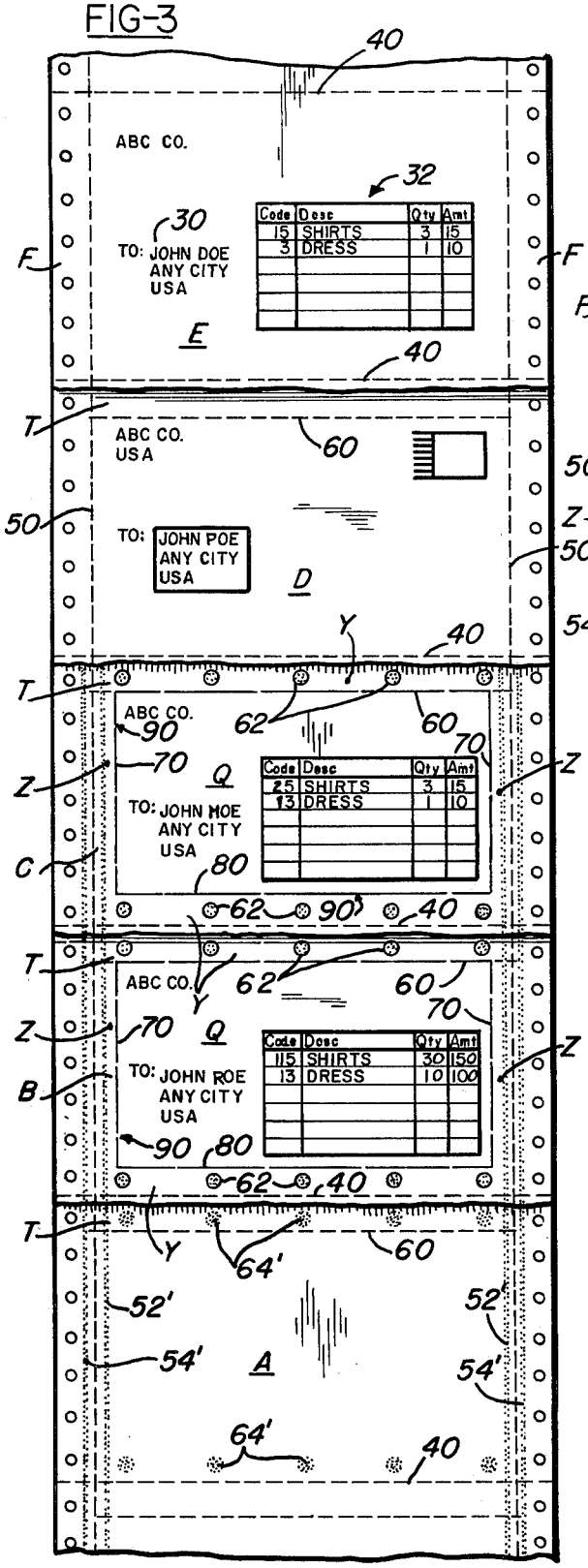
FIG-4
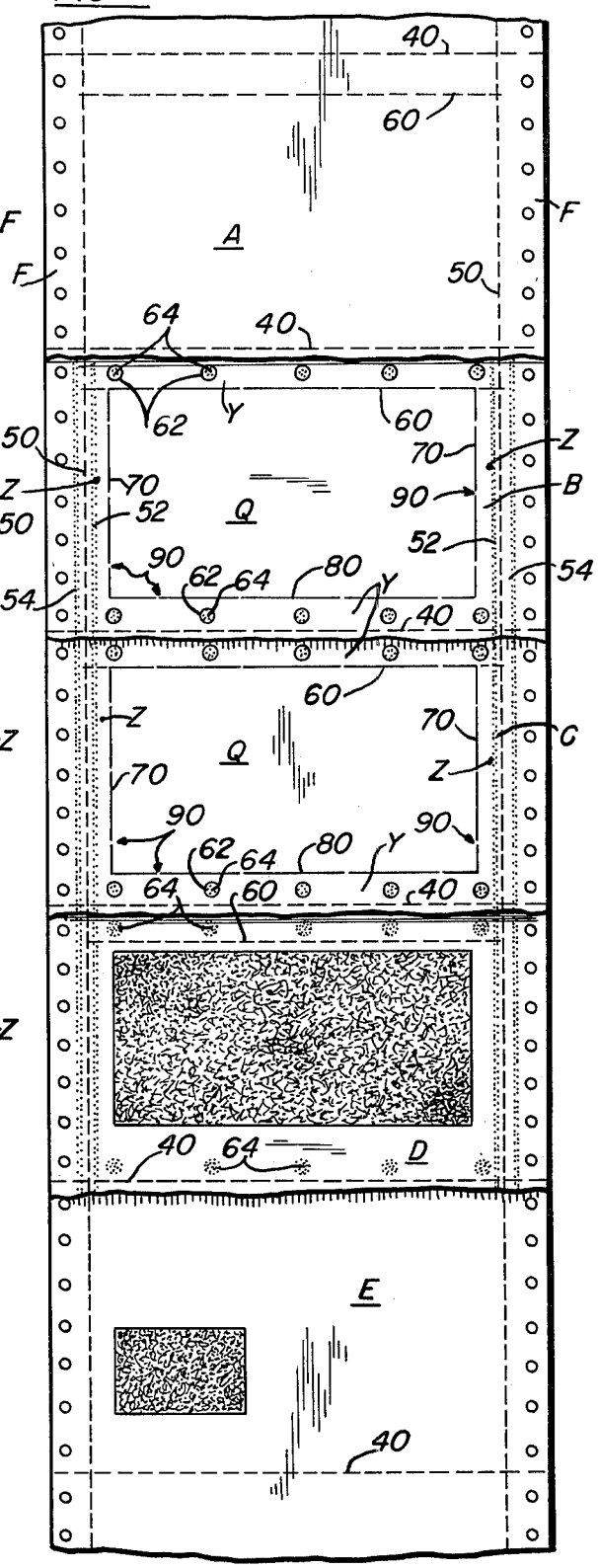
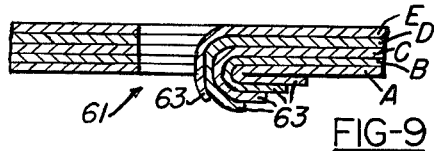
FIG-9

STUFFED ENVELOPE ASSEMBLY

BACKGROUND OF THE INVENTION

1. Field of the Invention

The subject invention relates to business forms, and more particularly to a business form of the type which comprises a plurality of end-interconnected stuffed envelopes, each of which comprise one or more insert panels housed between the front and rear panels of an envelope, in which the insert panels are housed, and wherein a record panel is provided in overlying relationship with the upper envelope-defining panel. Removable feed strips are provided along and beyond the side edge of each of the panels which collectively comprise a stuffed envelope for facilitating use of the stuffed envelopes with modern business equipment by which suitable original indicia is impact applied to an upper record or envelope panel of each envelope assembly, said indicia being impact transferred to other panels of each assembly.

After thus being processed each individual stuffed envelope may be severed from an adjoining stuffed envelope, concurrently with or after removal of the feed strips thereby providing a stuffed envelope ready for mailing.

Each of the insert panels are provided with weakening lines in spaced relationship with respect to their side and bottom edges for defining, in each of said panels, a central removable portion or subpanel which contains information for the addressee of the envelope.

Alignment of the various panels which collectively constitute each stuffed envelope is assured by reason of the fact that all four edges of the central, removable portion of each insert panel is secured and maintained in predetermined, connected relationship with respect to the marginal portions of the insert panel of which it forms a part, and with respect to the other panels of the envelope assembly, until such time as a positive force is applied to the central portion sufficient to break or rupture the connection between the central portion and the marginal portions of the insert panel of which it forms a part.

The various plys which comprise the stuffed envelope assembly are usually pre-printed prior to being collated, and after collation the assembly is adapted to be zig-zag folded for purposes of storage until used.

The fact that each of the panels of the assembly are the same size results in a substantially flat stuffed envelope of uniform thickness which permits vertical zig-zag stacking, in a manner not obtainable with stuffed envelope assemblies of the type in which the various panels thereof are of different sizes.

2. Description of Prior Art

Applicant is aware of the following patents which relate to manifold assemblies which comrise a plurality of panels, some or all of which span the full height and width of the final product, and/or which relate to envelope assemblies which include one or more insert panels, to wit:

Canadian Pat. No. 790,434 dated July 23, 1968 discloses a stuffed envelope structure which comprises three-like size panels, the marginal edges of each of which are interconnected. A tear strip 28 is defined at one end edge of each of the three panels by means of tear lines 30, and the opposite end edge of the intermediate panel is provided with a line of weakening adjacent its marginal edge, whereas the upper and lower edges of the intermediate panel are completely severed from their corresponding marginal portions. Removal of the tear strip provides access to an end edge of the intermediate panel which is then removable incident to severance of the line of weakening along its other end-adjacent edge.

The Chamberlain U.S. Pat. No. 3,211,469 dated Oct. 12, 1965 discloses a multiple manifoled message form which comprises a plurality of like-size panels each of which extend the full height and width of the final product, and wherein inserts are attached to the outer envelope-defining panels along all four edges thereof. Carbon or transfer sheets 8 and 23 are frangibly connected to their side edges at 12*a*, and may be removed by pulling on marginal strip 4, as clearly illustrated in FIG. 4. The remaining insert panel may not be so removed, but is adapted to be exposed by peeling top panel 7 along lines 13 and 14, as illustrated in FIG. 8.

The Steidinger U.S. Pat. No. 3,104,799 dated Sept. 24, 1965 discloses an envelope assembly constructed from a plurality of collated webs, wherein the insert sheets have three marginal edges which are completely free of the envelope assembly, and wherein their fourth marginal edge is secured to corresponding edges of the envelope-defining sheets. The insert sheets may be removed by severing tear strip 22 from the envelope along common perforated lines 23 in each of the sheets whereupon the insert sheets may then be withdrawn from the open-ended pocket of the envelope.

The Steidinger U.S. Pat. No. 3,339,827, dated Sept. 5, 1967 discloses a sealed envelope assembly fabricated from a plurality of continuous webs wherein an insert sheet has at least one edge which is disposed inwardly of and free of an adjacent peripherally sealed edge of the envelope assembly. As illustrated in FIG. 5, insert sheet 71 is frangibly attached to the marginal edges by ties 75 intermediate slit 74, and free end edge 72 is disposed inwardly of adhesive strip 73 which secures the outer envelope-defining panels to one another. In the modification of FIG. 6 both end edges of the insert panel are disposed inwardly of the adhesive strip wherein the side edges are attached relative to the envelope in a manner similar to the embodiment of FIG. 5. FIGS. 9–11 illustrate an insert sheet 22 which is die-cut to provide three peripheral free edges in much the same manner as the envelope assembly disclosed in U.S. Pat. No. 3,104,799.

The Steidinger U.S. Pat. No. 3,177,783, dated Apr. 13, 1965 discloses a method of forming a continuous series of detachable envelopes from a single web of paper.

The Steidinger U.S. Pat. No. 3,437,259, dated Apr. 8, 1969 discloses an envelope assembly which is constructed from a plurality of continuous webs, wherein a separate sheet which defines an insert panel is inserted into the envelope after it has been removed from the continuous series. The envelope may also include an insert similar to that disclosed in U.S. Pat. No. 3,104,799.

The Steidinger U.S. Pat. No. 3,777,971, dated Dec. 11, 1973 discloses an envelope assembly wherein the back panel of each envelope is provided with a plurality of aligned, spaced, upstanding embossments which circumscribe the periphery of an insert panel for the purpose of immobilizing movement of the insert panel within the envelope during processing.

The Pine, et al. U.S. Pat. No. 3,411,699, dated Nov. 19, 1968 discloses an envelope assembly which is fabricated in such a manner as to permit the envelope portion thereof to be used twice, once as an outgoing envelope, and thereafter as a return envelope.

The Van Malderghem U.S. Pat. No. 3,554,438, dated Jan. 12, 1971 discloses an envelope assembly having an insert at one end thereof which is attached to the access-end of the envelope-defining panel, whereby bursting of the envelope will sever the connection between the insert and the envelope so that the insert may be withdrawn from the envelope without requiring the recipient thereof to reach into the interior of the envelope structure. The other three edges of the insert are entirely free of the envelope at all times.

The Allison U.S. Pat. No. 3,606,138, dated Sept. 20, 1971 discloses an envelope having coupons housed therein, wherein the envelope-defining panels and the coupons are fabricated from a single blank of sheet material.

The Neubauer U.S. Pat. No. 3,608,816, dated Sept. 28, 1971 discloses an envelope assembly which includes an insert panel having three edges disposed inwardly of the adhesively interconnected portions of the envelope panels. The fourth edge of the insert panel projects forwardly of a portion of the envelope for defining a pull tab which may be grasped and pulled relative to the envelope to rupture releasable adhesive means by which the fourth side of the envelope is closed, thereby facilitating removal of the insert panel from the envelope.

The Steinhauser U.S. Pat. No. 3,701,468, dated Oct. 31, 1972 discloses a mailing envelope which includes a detachable message panel fabricated from a singularly rectangular blank which, when folded defines an envelope and a message panel.

The Amort U.S. Pat. No. 3,312,385, dated Apr. 4, 1967 discloses an envelope assembly wherein an insert sheet of a length less than the overall length of the front and rear plys of the original mailer envelope is secured, along three of its edges to the rear envelope panel for providing an open pocket therein. The insert sheet is adapted to be exposed incident to removal of the top sheet of the mailer envelope, and those portions of the bottom panel of the original mailer envelope which project beyond the open edge of the aforesaid pocket, are adapted to be folded over onto the insert panel for thereby completing a return mailing envelope.

The Wiessner U.S. Pat. No. 3,802,618, dated Apr. 9, 1974 discloses an envelope similar to the multiple-use envelope of the Pine, et al U.S. Pat. No. 3,411,499, supra.

The Kamstra U.S. Pat. No. 3,753,581, dated Aug. 21, 1973 discloses an envelope-type advertising brochure which comprises two sheets hingedly interconnected at one edge and wherein a plurality of intermediate sheets are disposed between and hingedly connected at one edge to an edge of the first two sheets.

The Kapitan U.S. Pat. No. 3,833,167, dated Sept. 3, 1974 discloses a single sheet which is folded to provide three equal size panels 20, 30 and 40 wherein the upper and lower edges of the envelope are not sealed, whereby the insert panel is attached to the envelope panels at folds 23 and 44.

The Schnitzer, et al U.S. Pat. No. 3,790,070, dated Feb. 5, 1974 discloses an assembly wherein only two panels, 10 and 14, extend the full height and width of the final product, and wherein insert panel 12 has three marginal edges which are disposed inwardly of and entirely free of the envelope edges, as shown in FIGS. 1 and 3.

The McNable U.S. Pat. No. 3,507,519, dated Apr. 21, 1970 discloses a four-layered envelope which is constructed from two folded sheets as best illustrated in FIGS. 3 and 4. All edges except the folded edges of the envelope are at least partially unsealed when the envelope is assembled.

The Lane et al. U.S. Pat. No. 2,192,268, dated Mar. 5, 1940 discloses a pad having groups of sheets wherein the upper and lower sheets 18 and 20 include adhesive bands 19 and 21 and wherein the intermediate sheets 22 are provided with a plurality of coinciding holes 23 through which adhesive extends for thereby interconnecting the various sheets of the pad.

Other multi-ply structures wherein one or more intermediate panels are secured to and between a pair of outer panels by an adhesive passing through apertures in the intermediate plys, are illustrated in U.S. Pat. Nos. 3,325,188; 3,081,111; 2,603,508; 2,330,045; and Netherlands Pat. No. 82,848.

Multi-ply structures utilizing bonding means which are distinguishable from the means set forth in the patents enumerated in the preceding paragraph are disclosed in U.S. Pat. Nos. 3,823,867; 3,806,165; 3,092,401; 3,065,979; 2,964,337; 2,907,585; 2,503,680 and 2,884,262.

In addition to the foregoing, the following U.S. Patents further illustrate the general state of the envelope art: U.S. Pat. Nos. 3,854,654; 3,841,549; 3,837,565; 3,823,867; 3,580,488; 3,554,447; 3,552,641; 3,497,132; 3,428,237; 3,337,120; 3,273,784; 3,210,093; 3,026,018; 2,722,369; 1,180,542 and 1,148,930.

SUMMARY OF THE INVENTION

The invention is directed to a stuffed envelope assembly and method of making same from a plurality of similar-size, preprinted panels each of which comprise a single ply which is fed to a collator where the individual panels of each of the plys are secured whereby to provide the finished article.

BRIEF DESCRIPTION OF THE DRAWINGS

FIG. 1 is a perspective view illustrating the manner in which a plurality of individual plys are collated for providing a stuffed envelope assembly embodying the teachings of the present invention.

FIG. 2 is a perspective view illustrating the manner in which the assembly of FIG. 1 is utilized for providing a plurality of individual, ready to mail, stuffed envelopes.

FIG. 3 is a top plan view of the envelope assembly after suitable indicia has been applied to the various panels thereof disclosing the structural details of the upper surface of each of the five panels of the five plys of FIG. 1

FIG. 4 is a view similar to FIG. 3 illustrating the under side of the various panels of FIG. 3.

FIGS. 5, 6 and 7 are perspective views illustrating the manner in which an envelope assembly is opened for removing the central portion of the insert sheets therefrom.

FIG. 8 is a fragmental view of a portion of a side edge of a stuffed envelope as it leaves printer P.

FIG. 9 is a sectional view, on a greatly enlarged scale taken on line 9—9 of FIG. 8.

DESCRIPTION OF THE PREFERRED EMBODIMENTS

With particular reference to FIG. 1 the numerals 10, 12, 14, 16 and 18 denote generally, a plurality of rolls of plys of paper, or the like, certain of which have been pre-printed or processed to contain suitable indicia, in a repetitive pattern, in each of a plurality of panels which are reproduced in each of said plys.

Each of the plys 10, 12, 14, 16 and 18 respectively are successively disposed in overlying relationship onto an endless conveyor 20 which, by way of example, includes means, such as upstanding pins 22 which engage and project through the alignment holes provided in feed strips F along each side edge of each of the plys, for thereby insuring accurate registry of the individual panels of each of the plys as they are advanced to the right in FIG. 1.

After thus being collated the resultant structure may be suitably zig-zag folded, as at 24, for storage, if desired.

The present invention is neither concerned with nor directed to the particular means by which the various plys are collated and then zig-zag folded, such means being old and well known to the art and form no part of the present inventive concept.

With particular reference now to FIG. 3 it will be noted that the upper surface of record panel E is provided with areas such as 30 and 32 onto which suitable original indicia is applied. Panel D represents the front or top panel of the envelope assembly, panels C and B represent the insert panels and panel A represents the rear or bottom panel of the envelope assembly.

In the usual course of events the original indicia applied to the record panel is an impact-applied ribbon copy whereas the indicia on the lower or under panels is impact-applied via carbon spots, transfer coatings, or the like.

As best illustrated in FIGS. 3 and 4 the top and bottom edges of the individual panels of each ply which collectively comprise a stuffed envelope are defined by transverse lines of weakening 40, which extend across the full width of each ply, and continuous longitudinal lines of weakening 50 which define the side edges of the panels of each ply and the removable feed strips F along the sides of each panel.

From the foregoing it will be noted that the overall size of each of panels A, B, C, D and E are the same and that each of said panels include corresponding top, bottom and side edges.

Each of panels A and D, viz the envelope-defining panels and panels B and C, the insert-defining panels are provided with a second transverse line of weakening 60 which is disposed inwardly of an in spaced parallelism with the upper edge of said panels, between lines of weakening 50, for thereby defining, in each of said panels a tear strip T.

The numerals 70 and 80, denote elongate slits which define other lines of weakening in each of the insert panels B and C wherein said lines are disposed in spaced parallelism with the side and bottom edges, respectively of an insert panel for thereby defining, with lines of weakening 60, a central, removable portion Q.

Uniformly satisfactory results have been obtained in those instances in which lines 70 and 80 comprise elongate slits wherein the adjacent ends are spaced apart to define easily ruptureable, narrow tabs or connectors 90 between removable portion Q and the corresponding marginal portions Y and Z of its respective insert panel.

As further illustrated in FIGS. 4 and 8, longitudinal stripes 52 of adhesive are disposed inboard of, and other longitudinal stripes 54 of adhesive may, if desired, be disposed outboard of the longitudinal lines of weakening 50 of the rear surface of plys B, C and D, whereby the side edges of each of panels A, B, C and D, when collated, are adhesively interconnected throughout and between their respective upper and lower edges. Longitudinal adhesive stripes 54 may be disposed along the under surface of the feed strips F of panels B, C and D for securing the feed strips of each panels A, B, C and D in absolute registry during and after collating, storage, and through printing, at P.

The feed strips F of the record panels E is not adhesively secured to the next lower feed strip of panels D, however uniformly satisfactory results have been obtained in those instances in which the feed strips of panels E are interconnected to the feed strips of panels D, C, B and A as at 61, by punching one or more tabs 63 into the strips, wherein three edges of the excised tabs are folded under and crimped, as illustrated in FIG. 9 for providing a connection which, though tenacious will nevertheless permit the uppermost feed strip of panel E to be easily separated from the next lower feed strip of panel D.

Each of plys 12 and 14 in which insert panels B and C are disposed, are provided with a transverse row of spaced, through apertures or holes 62 in spaced parallelism with the upper and lower edges 40 of said panels, within marginal portions Y thereof.

The underside of the top envelope-defining panel D is provided with a transverse row of spaced adhesive spots 64, wherein the relationship of apertures 62 of insert panels B and C, and adhesive spots 64 of envelope panel D is such that when ply 16 is laid upon ply 14, during collation (FIG. 1) the adhesive will pass through the apertures and engage the upper surface of the bottom envelope-defining ply 10 thereby securely bonding the upper and lower end edges of each of panels A, B, C and D. The numerals 52', 54' and 64' of FIG. 3 denote those portions of panels A, B and C which are engaged and thereby coated with the adhesive from adhesive stripes 52 and 54 and the adhesive spots 64, respectively of FIG. 4.

The particular means for applying adhesive stripes 52 and 54, and the adhesive spots 64 are conventional and well-known in the art, and comprise no part of the present invention.

With particular reference now to FIGS. 3 and 4 it will be noted that the adhesive stripes 52 and 54 and the rows of adhesive spots 64 are disposed in the end and side marginal portions Y and Z of the insert panels B and C, outwardly of the central, removable portions Q, whereby said central portions are, at all times, during collation, zig-zag folding, storage, processing through a printer or the like, bursting, mailing, and delivery to the addressee, firmly anchored, along all four edges, to the peripheral portions Y and Z of their respective panels and relative to the top and bottom envelope-defining panels A and D, thereby positively precluding any chance of accidental or unintentional misalignment or relative movement.

As schematically illustrated in FIG. 2 the zig-zig folded, interconnected, individual stuffed envelopes will provide a "square" stack 25 which is devoid of any tendency to shift, and wherein each stuffed envelope includes a uniformly flat upper surface. The envelopes thus stacked at 25 are adapted to be consecutively processed by feeding them through any suitable type of indicia-applying equipment, such as, by way of example, a printer denoted generally by the letter P.

Precise alignment of the panels which collectively comprise each stuffed envelope, as well as a record panel E for each envelope is maintained, through the indicia-applying operation by reason of feed strips F, the holes of which are engaged by feed pin wheels, not illustrated, of printer P. After indicia which is individual, and different for each stuffed envelope has been applied, feed strips F may be removed by hand, or by means of slitter 72, after which ply 18 in which the record panels E are contained is removed, by any suitable conventional means, not illustrated, at station R for thereby exposing the upper, indicia bearing surface of the top envelope panel D of a stuffed envelope.

Each of the individual stuffed envelopes are still interconnected at station S along their end edges to the end edges of the next preceeding and succeeding stuffed envelope, in which condition they are advanced to a burster, indicated generally by the letter X, where each stuffed envelope is separated from the assembly, ready for mailing to a designated addressee.

In FIG. 3 each of the five panels A, B, C, D and E are of a different, end-edge connected stuffed envelope, wherein each particular envelope is addressed to a different addressee and contain data which is germane and/or peculiar to the particular addressee.

Panel E of FIG. 3 is a record panel which overlies the stuffed envelope defined by panels D, C, B and A; panel D, as illustrated, is the front or upper envelope panel of the next succeeding stuffed envelope and overlies panels C, B and A; insert panel C of the next succeeding stuffed envelope overlies panels B and A; insert panel B of the next succeeding (lower) stuffed envelope overlies the rear or bottom panel A; and panel A is the rear or bottom panel of the next succeeding (lower) stuffed envelope.

As earlier noted, FIG. 3 discloses the upper side of the various panels E, D, C, B and A, whereas FIG. 4 discloses the underside of the panels of the stuffed envelope of FIG. 3, that is, panel A at the top of FIG. 4 is the bottom panel of the stuffed envelope at the top of FIG. 3; panel B of FIG. 4 is the next higher insert panel to panel A of the next succeeding stuffed envelope; panel C of FIG. 4 is the next higher insert panel to panel B of the next succeeding stuffed envelope; panel D is the next higher envelope panel to insert panel C of the next succeeding stuffed envelope, and panel E is the next record panel to envelope panel D of the next succeeding stuffed envelope.

It should, of course, be understood that all of the panels which collectively comprise a stuffed envelope, including the record panel for that particular envelope are addressed to the same addressee and contain the same distinctive indicia with respect to the particular addressee.

Each stuffed envelope is adapted to be opened by removing the composite tear strip T', as in FIG. 5, along weakening lines 60 in each of panels A, B, C and D, thereby opening the envelope along its upper edge and exposing the upper ends of insert panels B and C at, and as defined by edges 60'.

It should be understood that the stuffed envelope of FIG. 5 and tear strip T' comprise the thickness of four panels, A, B, C and D.

The upper ends of envelope panels A and D of the envelope of FIG. 6 may be separated, such as, by way of example, by inserting the thumb and forefinger and grasping the upper part of central portion Q of insert panels B and C, and by pulling upwardly on portion Q the tabs or connectors 90 along the side and bottom edges of Q will be ruptured, thereby freeing central portion Q of the insert panels B and C for removal from the envelope, as illustrated in FIG. 7.

While two insert panels, B and C have been illustrated, it should be understood that one or more than two such panels may be utilized.

In those instances in which record panels E are not required ply 18 would be omitted, in which event the indicia applied at printer P would be applied directly to the upper surface of the top envelope panel D.

With particular reference now to FIG. 2 is should be understood that in those instances in which it is or might be desirable to remove record panels, E, with their respective feed strips F, intact, station R at which the record sheets are removed from the stuffed envelope assemblies would be disposed to the left of, that is, in advance of slitter 72, in which event the slitter would remove feed strips F from the front, insert and rear panels of each successive stuffed envelope assembly.

What is claimed is:

1. A continuous assembly of record sheets and stuffed envelopes, which comprises a plurality of overlying continuous plys, longitudinal and transverse lines of weakening in each of said plys which subdivide them into similar sized record, front, insert and rear panels each of which have corresponding top, bottom and side edges with removable feed strips along their respective side edges, another transverse line of weakening in spaced parallelism with the top edge of the insert, front and rear panels for defining a tear strip in and across the upper end of said panels, other lines of weakening in the insert panels in spaced parallelism with the bottom and side edges thereof defining a central, removable portion, means interconnecting the marginal portions of the front, insert and rear panels along the tear strips and outwardly of the central, removable portion of the insert panels for defining a stuffed envelope which is separable along the first mentioned transverse lines of weakening from adjoining envelopes of the continuous envelope assembly, and other means interconnecting the feed strips of the record, front, insert and rear panels of the envelope assembly, the record panel per se being disposed in free, overlying, aligned but unattached relationship with the front panel of its respective stuffed envelope.

2. An assembly as called for in claim 1, wherein the tear strip and bottom marginal portion of the insert panels are provided with a plurality of transversely aligned holes, a plurality of spots of adhesive on the upper surface of the tear strip and bottom marginal portion of the rear panel in alignment with said holes, whereby the adhesive is disposed in contacting relationship with the undersurface of portions of the tear strip and bottom marginal portions of the front panel through said holes for interconnecting the tear strips and bottom marginal portions of the front, insert and rear panels.

3. An assembly as called for in claim 2, wherein an adhesive stripe is applied to the upper surface of the side marginal portions of the rear and each insert panel for adherance to the lower surface of the side marginal portions of each superposed insert and front panel.

4. An assembly as called for in claim 1, wherein stripes of adhesive on the upper surface of the feed strips of the rear and insert panels permanently connect the lower surface of the feed strips of each superposed insert and front panel, and wherein other means releasably secure the feed strips of the record panel relative to the other feed strips of the panels of its stuffed envelope.

5. An assembly as called for in claim 4, wherein the feed strips of the record panels are releasably secured relative to the other feed strips by means of a crimp lock.

6. An assembly as called for in claim 1, wherein transfer means are provided on the undersurface of a between the record, front and insert panels for duplicating on the upper surface of the front and insert panels some or all of the indicia applied to the upper surface of the record panel.

7. A continuous assembly of top opening stuffed envelopes, which comprises, a plurality of overlying continuous plys, longitudinal and transverse lines of weakening in each of said plys subdividing them into similar sized panels having corresponding top, bottom and side edges with feed strips along their respective side edges, said envelopes each being adapted to be opened along said top edges, the top ply defining a record panel and the next lower and bottom ply defining front and rear envelope panels, and the panels of the other intermediate plys defining insert panels, another transverse line of weakening in spaced parallellism with the top edges of the insert, front and rear envelope panels defining a tear strip in and across the upper end of each of the insert, front and rear envelope panels, lines of weakening in each insert panel in spaced parallelism with the bottom and said side edges thereof defining a central, removable portion, said central, removable portions being circumscribed by outwardly disposed top, bottom and side marginal portions of each insert panel, wherein the top marginal portion comprises a tear strip, said central portions being connected to said insert panels along essentially the entire periphery of said central portions by said lines of weakening, so that all edges of said removable central portions are connected to said insert panels, means fixedly interconnecting the marginal portions of the insert panels to one another and to the front and rear envelope panels for defining a sealed stuffed envelope which is separable along its upper and lower edges from adjoining stuffed envelopes of the continuous stuffed envelope assembly, means interconnecting the feed strips of the record, insert, front and rear envelope panels of the envelope assembly, other means interconnecting the feed strips of the record panel to the feed strips of the insert, front and rear envelope panels, the record panel per se being disposed in free, overlying, aligned but unattached relationship with the front envelope panel of its respective stuffed envelope, and wherein removal of the tear strips of a stuffed envelope exposes the upper edges of the central removable portion of the insert panels for separation of their respective connected side and bottom edges from corresponding side and bottom marginal portions of their respective insert panels, incident to removal of the central portions from the envelope.

8. An assembly as called for in claim 7, wherein the lines of weakening which define the central removable portion of each insert panel comprise elongate slits the adjacent ends of adjoining slits being spaced to define narrow, easily rupturable connector tabs between and by which the central portion is positively, though releasably interconnected to the marginal portions of its corresponding insert panel.

9. An assembly as called for in claim 7, wherein transfer means are provided on the underside of or between the front envelope panel and the insert panels for duplicating on the insert panels some or all of the indicia applied to the upper surface of the front envelope panel.

10. A stuffed envelope comprising, in combination, a record panel, a front envelope panel, one or more insert panels and a bottom envelope panel, wherein each of said panels are of the same overall size and include corresponding top, bottom and side edges, and wherein the side edges of each of said panels terminate in and are defined by removable feed strips, a transverse tear strip spanning the upper portion of the insert and envelope panels, each insert panel having lines of weakening in spaced parallelism with the bottom and side edges defining, with the tear strip, marginal portions which define and circumscribe a central, removable portion, means interconnecting the tear strips and marginal portions of the insert and envelope panels, and means interconnecting the feed strips of the record, envelope and insert panels to secure the record panel, per se, in overlying, aligned but unattached relationship with any portion of the front envelope panel.

* * * * *